US007768192B2

(12) United States Patent
Van De Ven et al.

(10) Patent No.: US 7,768,192 B2
(45) **Date of Patent: *Aug. 3, 2010**

(54) LIGHTING DEVICE AND LIGHTING METHOD

(75) Inventors: Antony Paul Van De Ven, Hong Kong (HK); Gerald H. Negley, Durham, NC (US)

(73) Assignee: Cree LED Lighting Solutions, Inc., Durham, NC (US)

( * ) Notice: Subject to any disclaimer, the term of this patent is extended or adjusted under 35 U.S.C. 154(b) by 343 days.

This patent is subject to a terminal disclaimer.

(21) Appl. No.: 11/613,714

(22) Filed: Dec. 20, 2006

(65) Prior Publication Data

US 2007/0139920 A1 Jun. 21, 2007

Related U.S. Application Data

(60) Provisional application No. 60/752,555, filed on Dec. 21, 2005.

(51) Int. Cl.
*H01J 1/62* (2006.01)

(52) U.S. Cl. ..... 313/503; 362/231

(58) Field of Classification Search ..... 362/231, 362/230, 545, 555, 800; 315/291; 313/503, 313/467, 468

See application file for complete search history.

(56) References Cited

U.S. PATENT DOCUMENTS 3,805,937 A 4/1974 Hatanaka et al.
3,875,456 A 4/1975 Kano et al.
3,927,290 A 12/1975 Denley
4,120,026 A 10/1978 Tsuchihashi et al.
4,325,146 A 4/1982 Lennington
4,408,157 A 10/1983 Beaubien
4,420,398 A 12/1983 Castino
4,710,699 A 12/1987 Miyamoto
4,772,885 A 9/1988 Uehara et al.
5,087,883 A 2/1992 Hoffman
5,166,815 A 11/1992 Elderfield (Continued)

FOREIGN PATENT DOCUMENTS

DE 3 916 875 12/1990

(Continued)

OTHER PUBLICATIONS

U.S. Appl. No. 61/075,513, filed Jun. 25, 2008.

(Continued)

*Primary Examiner*—Gunyoung T Lee
(74) *Attorney, Agent, or Firm*—Burr & Brown

(57) ABSTRACT

A lighting device comprising sources of visible light comprising solid state light emitters and/or luminescent materials emitting three or four different hues. A first group of the sources, when illuminated, emit light of two hues which, if combined, would produce illumination having coordinates within an area on a 1931 CIE Chromaticity Diagram defined by points having coordinates: 0.59, 0.24; 0.40, 0.50; 0.24, 0.53; 0.17, 0.25; and 0.30, 0.12. A second group of the sources is of an additional hue. Mixing light from the first and second groups produces illumination within ten MacAdam ellipses of the blackbody locus. Also, a lighting device comprising a white light source having a CRI of 75 or less and at least one solid state light emitters and/or luminescent material. Also, methods of lighting.

78 Claims, 4 Drawing Sheets

U.S. PATENT DOCUMENTS

| | | | | |
|---|---|---|---|---|
| 5,264,997 | A | 11/1993 | Hutchinsson et al. | |
| 5,407,799 | A | 4/1995 | Studier | |
| 5,410,519 | A | 4/1995 | Hall et al. | |
| 5,477,436 | A | 12/1995 | Betling et al. | |
| 5,563,849 | A | 10/1996 | Hall et al. | |
| 5,803,579 | A | 9/1998 | Turnbull et al. | |
| 5,851,063 | A | 12/1998 | Doughty et al. | |
| 5,959,316 | A | 9/1999 | Lowery | |
| 6,066,861 | A | 5/2000 | Höhn et al. | |
| 6,076,936 | A | 6/2000 | George | |
| 6,084,250 | A | 7/2000 | Justel et al. | |
| 6,095,666 | A | 8/2000 | Salam | |
| 6,132,072 | A | 10/2000 | Turnbull et al. | |
| 6,212,213 | B1 | 4/2001 | Weber et al. | |
| 6,234,648 | B1 | 5/2001 | Borner et al. | |
| 6,245,259 | B1 | 6/2001 | Höhn et al. | |
| 6,252,254 | B1 | 6/2001 | Soules | |
| 6,255,670 | B1 * | 7/2001 | Srivastava et al. | 257/89 |
| 6,278,135 | B1 | 8/2001 | Srivastava et al. | |
| 6,292,901 | B1 | 9/2001 | Lys et al. | |
| 6,294,800 | B1 * | 9/2001 | Duggal et al. | 257/89 |
| 6,319,425 | B1 | 11/2001 | Tasaki et al. | |
| 6,335,538 | B1 | 1/2002 | Prutchi et al. | |
| 6,337,536 | B1 | 1/2002 | Matsubara et al. | |
| 6,348,766 | B1 | 2/2002 | Ohishi et al. | |
| 6,350,041 | B1 | 2/2002 | Tarsa et al. | |
| 6,357,889 | B1 | 3/2002 | Duggal et al. | |
| 6,394,621 | B1 | 5/2002 | Hanewinkel | |
| 6,429,583 | B1 | 8/2002 | Levinson et al. | |
| 6,441,558 | B1 | 8/2002 | Muthu et al. | |
| 6,480,299 | B1 | 11/2002 | Drakopoulos et al. | |
| 6,501,100 | B1 | 12/2002 | Srivastava et al. | |
| 6,504,179 | B1 | 1/2003 | Ellens et al. | |
| 6,513,949 | B1 | 2/2003 | Marshall et al. | |
| 6,522,065 | B1 | 2/2003 | Srivastava et al. | |
| 6,538,371 | B1 | 3/2003 | Duggal et al. | |
| 6,550,949 | B1 | 4/2003 | Bauer et al. | |
| 6,552,495 | B1 | 4/2003 | Chang | |
| 6,577,073 | B2 | 6/2003 | Shimizu et al. | |
| 6,578,986 | B2 | 6/2003 | Swaris et al. | |
| 6,592,810 | B2 | 7/2003 | Nishida et al. | |
| 6,600,175 | B1 | 7/2003 | Baretz et al. | |
| 6,600,324 | B2 | 7/2003 | St-Germain | |
| 6,603,258 | B1 | 8/2003 | Mueller-Mach et al. | |
| 6,608,485 | B2 | 8/2003 | St-Germain | |
| 6,616,862 | B2 | 9/2003 | Srivastava et al. | |
| 6,624,350 | B2 | 9/2003 | Nixon et al. | |
| 6,636,003 | B2 | 10/2003 | Rahm et al. | |
| 6,642,666 | B1 | 11/2003 | St-Germain | |
| 6,685,852 | B2 | 2/2004 | Setlur et al. | |
| 6,686,691 | B1 | 2/2004 | Mueller et al. | |
| 6,692,136 | B2 | 2/2004 | Marshall et al. | |
| 6,703,173 | B2 | 3/2004 | Lu et al. | |
| 6,712,486 | B1 | 3/2004 | Popovich et al. | |
| 6,737,801 | B2 | 5/2004 | Ragle | |
| 6,744,194 | B2 | 6/2004 | Fukasawa et al. | |
| 6,762,563 | B2 | 7/2004 | St-Germain | |
| 6,784,463 | B2 | 8/2004 | Camras et al. | |
| 6,791,257 | B1 | 9/2004 | Sato et al. | |
| 6,817,735 | B2 | 11/2004 | Shimizu et al. | |
| 6,841,804 | B1 | 1/2005 | Chen et al. | |
| 6,851,834 | B2 | 2/2005 | Leysath | |
| 6,880,954 | B2 | 4/2005 | Ollett et al. | |
| 6,882,101 | B2 | 4/2005 | Ragle | |
| 6,914,267 | B2 | 7/2005 | Fukasawa et al. | |
| 6,936,857 | B2 | 8/2005 | Doxsee et al. | |
| 6,967,116 | B2 | 11/2005 | Negley | |
| 6,980,176 | B2 | 12/2005 | Matsumoto et al. | |
| 7,005,679 | B2 | 2/2006 | Tarsa et al. | |
| 7,008,078 | B2 | 3/2006 | Shimizu et al. | |
| 7,009,343 | B2 | 3/2006 | Lim et al. | |
| 7,014,336 | B1 | 3/2006 | Ducharme et al. | |
| 7,023,019 | B2 | 4/2006 | Maeda et al. | |
| 7,061,454 | B2 | 6/2006 | Sasuga et al. | |
| 7,066,623 | B2 | 6/2006 | Lee et al. | |
| 7,083,302 | B2 | 8/2006 | Chen et al. | |
| 7,093,958 | B2 | 8/2006 | Coushaine | |
| 7,095,056 | B2 | 8/2006 | Vitta et al. | |
| 7,102,172 | B2 | 9/2006 | Lynch et al. | |
| 7,116,308 | B1 | 10/2006 | Heeks et al. | |
| 7,118,262 | B2 | 10/2006 | Negley et al. | |
| 7,125,143 | B2 | 10/2006 | Hacker | |
| 7,135,664 | B2 | 11/2006 | Vornsand et al. | |
| 7,164,231 | B2 | 1/2007 | Choi et al. | |
| 7,207,691 | B2 | 4/2007 | Lee et al. | |
| 7,213,940 | B1 | 5/2007 | Van De Ven et al. | |
| 7,215,074 | B2 | 5/2007 | Shimizu et al. | |
| 7,232,212 | B2 | 6/2007 | Iwase | |
| 7,239,085 | B2 | 7/2007 | Kawamura | |
| 7,250,715 | B2 | 7/2007 | Mueller et al. | |
| 7,255,457 | B2 | 8/2007 | Ducharme et al. | |
| 7,256,557 | B2 | 8/2007 | Lim | |
| 7,322,732 | B2 | 1/2008 | Negley et al. | |
| 7,329,024 | B2 | 2/2008 | Lynch et al. | |
| 7,358,954 | B2 | 4/2008 | Negley et al. | |
| 7,365,485 | B2 | 4/2008 | Fukasawa et al. | |
| 7,387,405 | B2 | 6/2008 | Ducharme et al. | |
| 7,422,504 | B2 | 9/2008 | Maeda et al. | |
| 7,453,195 | B2 | 11/2008 | Radkov | |
| 7,474,044 | B2 | 1/2009 | Ge | |
| 2001/0002049 | A1 | 5/2001 | Reeh et al. | |
| 2002/0006044 | A1 | 1/2002 | Harbers et al. | |
| 2002/0070681 | A1 | 6/2002 | Shimizu et al. | |
| 2002/0087532 | A1 | 7/2002 | Barritz et al. | |
| 2002/0149576 | A1 | 10/2002 | Tanaka et al. | |
| 2003/0026096 | A1 | 2/2003 | Ellens et al. | |
| 2003/0030063 | A1 | 2/2003 | Sosniak et al. | |
| 2003/0067773 | A1 | 4/2003 | Marshall et al. | |
| 2003/0146411 | A1 | 8/2003 | Srivastava et al. | |
| 2003/0214817 | A1 | 11/2003 | Hacker | |
| 2003/0222268 | A1 | 12/2003 | Yocom et al. | |
| 2004/0046178 | A1 | 3/2004 | Sano | |
| 2004/0105261 | A1 | 6/2004 | Ducharme et al. | |
| 2004/0105264 | A1 | 6/2004 | Spero | |
| 2004/0212998 | A1 | 10/2004 | Mohacsi | |
| 2004/0217364 | A1 | 11/2004 | Tarsa et al. | |
| 2004/0218387 | A1 | 11/2004 | Gerlach | |
| 2004/0218388 | A1 | 11/2004 | Suzuki | |
| 2004/0239839 | A1 | 12/2004 | Hong | |
| 2004/0264193 | A1 | 12/2004 | Okumura | |
| 2004/0264212 | A1 | 12/2004 | Chung et al. | |
| 2005/0002191 | A1 | 1/2005 | Shimizu et al. | |
| 2005/0007306 | A1 | 1/2005 | Iisaka et al. | |
| 2005/0052378 | A1 | 3/2005 | Hacker | |
| 2005/0082974 | A1 | 4/2005 | Fukasawa et al. | |
| 2005/0127381 | A1 | 6/2005 | Vitta et al. | |
| 2005/0190141 | A1 | 9/2005 | Roth et al. | |
| 2005/0231976 | A1 | 10/2005 | Keuper et al. | |
| 2005/0243556 | A1 | 11/2005 | Lynch | |
| 2005/0251698 | A1 | 11/2005 | Lynch et al. | |
| 2005/0259423 | A1 | 11/2005 | Heuser et al. | |
| 2005/0274972 | A1 | 12/2005 | Roth et al. | |
| 2006/0012989 | A1 | 1/2006 | Lee et al. | |
| 2006/0022582 | A1 | 2/2006 | Radkov | |
| 2006/0060872 | A1 | 3/2006 | Edmond et al. | |
| 2006/0067073 | A1 | 3/2006 | Ting | |
| 2006/0105482 | A1 | 5/2006 | Alferink et al. | |
| 2006/0113548 | A1 | 6/2006 | Chen et al. | |
| 2006/0138435 | A1 | 6/2006 | Tarsa et al. | |
| 2006/0138937 | A1 | 6/2006 | Ibbetson | |
| 2006/0152140 | A1 | 7/2006 | Brandes | |
| 2006/0152172 | A9 | 7/2006 | Mueller et al. | |
| 2006/0180818 | A1 | 8/2006 | Nagai et al. | |
| 2006/0181192 | A1 | 8/2006 | Radkov | |

| | | | |
|---|---|---|---|
| 2006/0245184 | A1 | 11/2006 | Galli |
| 2007/0001188 | A1 | 1/2007 | Lee |
| 2007/0001994 | A1 | 1/2007 | Roth |
| 2007/0041220 | A1 | 2/2007 | Lynch |
| 2007/0051966 | A1 | 3/2007 | Higashi et al. |
| 2007/0090381 | A1 | 4/2007 | Otsuka et al. |
| 2007/0137074 | A1 | 6/2007 | Van De Ven et al. |
| 2007/0139920 | A1 | 6/2007 | Van De Ven et al. |
| 2007/0139923 | A1 | 6/2007 | Negley |
| 2007/0170447 | A1 | 7/2007 | Negley |
| 2007/0171145 | A1 | 7/2007 | Coleman et al. |
| 2007/0202623 | A1 | 8/2007 | Gao |
| 2007/0223219 | A1 | 9/2007 | Medendorp et al. |
| 2007/0236911 | A1 | 10/2007 | Negley |
| 2007/0247414 | A1 | 10/2007 | Robert |
| 2007/0247847 | A1 | 10/2007 | Villard |
| 2007/0262337 | A1 | 11/2007 | Villard |
| 2007/0263393 | A1 | 11/2007 | Van De Ven et al. |
| 2007/0267983 | A1 | 11/2007 | Van De Ven et al. |
| 2007/0274063 | A1 | 11/2007 | Negley |
| 2007/0274080 | A1 | 11/2007 | Negley et al. |
| 2007/0276606 | A1 | 11/2007 | Radkov |
| 2007/0278503 | A1 | 12/2007 | Van De Ven et al. |
| 2007/0278934 | A1 | 12/2007 | Van De Ven et al. |
| 2007/0278974 | A1 | 12/2007 | Van De Ven |
| 2007/0279440 | A1 | 12/2007 | Negley |
| 2007/0279903 | A1 | 12/2007 | Negley et al. |
| 2007/0280624 | A1 | 12/2007 | Negley et al. |
| 2008/0084685 | A1 | 4/2008 | Van De Ven |
| 2008/0084700 | A1 | 4/2008 | Van De Ven |
| 2008/0084701 | A1 | 4/2008 | Van De Ven et al. |
| 2008/0088248 | A1 | 4/2008 | Myers |
| 2008/0089053 | A1 | 4/2008 | Negley |
| 2008/0106895 | A1 | 5/2008 | Van De Ven |
| 2008/0106907 | A1 | 5/2008 | Trott et al. |
| 2008/0112168 | A1 | 5/2008 | Pickard et al. |
| 2008/0112170 | A1 | 5/2008 | Trott et al. |
| 2008/0112183 | A1 | 5/2008 | Negley |
| 2008/0130265 | A1 | 6/2008 | Negley |
| 2008/0130285 | A1 | 6/2008 | Negley |
| 2008/0136313 | A1 | 6/2008 | Van De Ven et al. |
| 2008/0137347 | A1 | 6/2008 | Trott et al. |
| 2008/0170396 | A1 | 7/2008 | Yuan et al. |
| 2008/0179602 | A1 | 7/2008 | Negley |
| 2008/0192462 | A1 | 8/2008 | Steedly et al. |
| 2008/0192493 | A1 | 8/2008 | Villard |
| 2008/0211416 | A1 | 9/2008 | Negley et al. |
| 2008/0231201 | A1 | 9/2008 | Higley et al. |
| 2008/0259589 | A1 | 10/2008 | Van De Ven et al. |
| 2008/0278928 | A1 | 11/2008 | Van De Ven et al. |
| 2008/0278940 | A1 | 11/2008 | Van De Ven et al. |
| 2008/0278950 | A1 | 11/2008 | Pickard et al. |
| 2008/0278952 | A1 | 11/2008 | Trott et al. |
| 2008/0304260 | A1 | 12/2008 | Van De Ven et al. |
| 2008/0304261 | A1 | 12/2008 | Van De Ven et al. |
| 2008/0304269 | A1 | 12/2008 | Pickard et al. |
| 2008/0309255 | A1 | 12/2008 | Myers |
| 2008/0310154 | A1 | 12/2008 | Van De Ven et al. |
| 2009/0002986 | A1 | 1/2009 | Medendorp et al. |

FOREIGN PATENT DOCUMENTS

| | | |
|---|---|---|
| DE | 3916875 | 12/1990 |
| DE | 10-335077 | 3/2005 |
| EP | 0 838 866 | 4/1998 |
| EP | 0 971 421 | 1/2000 |
| EP | 1 024 399 | 8/2000 |
| EP | 1 081 771 | 3/2001 |
| EP | 1 160 883 | 12/2001 |
| EP | 1 193 772 | 4/2002 |
| EP | 1 367 655 | 12/2003 |
| EP | 1 380 876 | 1/2004 |
| EP | 1 462 711 | 12/2004 |
| EP | 1 526 057 | 4/2005 |
| EP | 1 566 848 | 8/2005 |
| EP | 1 571 715 | 9/2005 |
| EP | 1 760 795 | 1/2006 |
| JP | 04-159519 | 6/1992 |
| JP | 09-146089 | 6/1997 |
| JP | 10-163535 | 6/1998 |
| JP | 2000-022222 | 1/2000 |
| JP | 2000-183408 | 6/2000 |
| JP | 2001-111114 | 4/2001 |
| JP | 2001-156331 | 6/2001 |
| JP | 2001-307506 | 11/2001 |
| JP | 2002-150821 | 5/2002 |
| JP | 2003-515956 | 5/2003 |
| JP | 2003-529889 | 10/2003 |
| JP | 2004-080046 | 3/2004 |
| JP | 2004-103443 | 4/2004 |
| JP | 2004-253309 | 9/2004 |
| JP | 2004-356116 | 12/2004 |
| JP | 2004-363055 | 12/2004 |
| JP | 2005-005482 | 1/2005 |
| JP | 2005-101296 | 4/2005 |
| JP | 2005-142311 | 6/2005 |
| JP | 2007-122950 | 5/2007 |
| JP | 2007-141737 | 6/2007 |
| TW | 546854 | 8/2003 |
| TW | 200604325 A | 2/2006 |
| TW | 200635087 A | 10/2006 |
| WO | 98/43014 | 10/1998 |
| WO | 99/66483 | 12/1999 |
| WO | 00/34709 | 6/2000 |
| WO | 01/41215 | 6/2001 |
| WO | 01/43113 | 6/2001 |
| WO | 01/69692 | 9/2001 |
| WO | 03/056876 | 7/2003 |
| WO | 03/091771 | 11/2003 |
| WO | 2004/068909 | 8/2004 |
| WO | 2004/100611 | 11/2004 |
| WO | 2005/004202 | 1/2005 |
| WO | 2005013365 | 2/2005 |
| WO | 2005/013365 | 10/2005 |
| WO | 2005/124877 | 12/2005 |
| WO | 2005124877 | 12/2005 |
| WO | WO 2005/124877 | 12/2005 |
| WO | 2006/028312 | 3/2006 |
| WO | 2007/061758 | 5/2007 |

OTHER PUBLICATIONS

U.S. Appl. No. 12/248,220, filed Oct. 9, 2008.
U.S. Appl. No. 12/277,745, filed Nov. 25, 2008.
Chhajed et al., *Influence of junction temperature on chromaticity and color-rendering properties of trichromatic white-light sources based on light-emitting diodes*, Journal of Applied Physics 87, 054506 (2005), pp. 1-8.
Color Kinetics Incorporated, *Color Quality of Intelligent Solid-State Lighting Systems*, Color Quality of Solid-State Light Sources, pp. 1-3, Mar. 2005.
Narendran et al., *Color Rendering Properties of LED Light Sources*, Lighting Research Center, Renssalaer Polytechnic Institute, pp. 1-8, 2002.
Color Kinetics Support : White Papers & Presentations, *Solid State Lighting White Papers & Presentations*, http://www.colorkinetics.com/support/whitepapers/, pp. 1-4, Feb. 22, 2006.
U.S. Appl. No. 11/613,692, filed Dec. 20, 2006.
U.S. Appl. No. 11/613,714, filed Dec. 20, 2006.
U.S. Appl. No. 11/736,761, filed Apr. 18, 2007.
U.S. Appl. No. 11/736,799, filed Apr. 18, 2007.
U.S. Appl. No. 11/755,153, filed May 30, 2007.
U.S. Appl. No. 11/936,163, filed Nov. 7, 2007.
U.S. Appl. No. 12/117,122, filed May 8, 2008.
U.S. Appl. No. 12/117,131, filed May 8, 2008.
U.S. Appl. No. 12/117,136, filed May 8, 2008.

U.S. Appl. No. 11/948,021, filed Nov. 30, 2007.
U.S. Appl. No. 11/947,323, filed Nov. 29, 2007.
U.S. Appl. No. 11/951,626, filed Dec. 6, 2007.
U.S. Appl. No. 12/035,604, filed Feb. 22, 2008
U.S. Appl. No. 12/117,148, filed May 8, 2008.
U.S. Appl. No. 12/117,271, filed May 8, 2008.
U.S. Appl. No. 12/057,748, filed Mar. 28, 2008.
U.S. Appl. No. 11/743,324, filed May 2, 2007.
U.S. Appl. No. 11/032,363, filed Jan. 10, 2005.
U.S. Appl. No. 11/843,243, filed Aug. 22, 2007.
Van de Ven et al., "Warm White Illumination with High CRI and High Efficacy by Combining 455 nm Excited Yellowish Phosphor LEDs and Red A1InGaP LEDs", First International Conference on White LEDs and Solid State Lighting.
Cree® XLamp® 7090 XR-E Series LED Binning and Labeling.
Krames, "Lumileds Lighting, Light from Silicon Valley" Progress and Future Direction of LED Technology, SSL Workshop, Nov. 13, 2003, pp. 1-21.
White Light LED, Part Nos. NSPW300BS and NSPW312BS, High Brightness LEDs, Nov. 12, 1999, Publisher: Nichia Corporation.
Chhajed, S., *Influence of junction temperature on chromaticity and color-rendering properties of trichromatic white-light sources . . .* , Journal of Applied Physics, 2005, vol. 97pp. 1-8.
Color Kinetics Inc., Color Kinetics Support : White Papers & Presentations; available at http://wvvw.colorkinetics.com/support/whitepapers/:, Solid State Lighting White Papers & Presentations, Feb. 22, 2006, pp. 1-4.
Color Kinetics Inc., *Color Quality of Intelligent Solid-State Light Systems*, Color Quality of Solid-State Light Sources, Mar. 2005, pp. 1-3.
Compound Semiconductors Online, "LED Lighting Fixtures, Inc. Sets World Record at 80 Lumens per Watt for Warm White", Compound Semiconductors Online, May 30, 2006, pp. 1.
Cree, Inc., "Cree® Xlamp® 7090 XR-E Series LED Binning and Labeling," Application Note: CLD-AP08.000, 7pp (2006).
CSA International, "Test Data Report," Project No. 1786317, Report No. 1786317-1 (Apr. 2006).
DOE SSL CALiPer Report, "Product Test Reference: CALiPER 07-31 Downlight Lamp".
DOE SSL CALiPer Report, "Product Test Reference: CALiPER 07-47 Downlight Lamp".
Krames et al., *Lumileds Lighting, Light from Silicon Valley*, Progress and Future Direction of LED Technology, SSL Workshop, Nov. 13, 2003, Publisher: Limileds Lighting Inc., pp. 1-21.
Narendran et al., "Solid State lighting: failure analysis of white LEDs," Journal of Cystal Growth, vol. 268, Issues 1-4, Aug. 2004, Abstract.
Narendran et al., *Color Rendering Properties of LED Light Sources*, 2002, pp. 1-8.
Nichia, White Light LED, Part Nos. NSPW300BS and NSPW312BS, High Brightness LEDs, Nov. 12, 1999, Publisher: Nichia Corporation.
Press Release from LED Lighting Fixtures dated Apr. 24, 2006 entitled "LED Lighting Fixtures, Inc. achieves unprecedented gain in light output from new luminaire".
Press Release from LED Lighting Fixtures dated Feb. 16, 2006 entitled "LED Lighting Fixtures, Inc. Announces Record Performance".
Press Release from LED Lighting Fixtures dated Feb. 7, 2007 entitled "LED Lighting Fixtures Announces its first LED-based Recessed Down Light".
Press Release from LED Lighting Fixtures dated Jan. 26, 2006 entitled "LED Lighting Fixtures Creates 750 Lumen Recessed Light and Uses Only 16 Watts of Power".
Press Release from LED Lighting Fixtures dated May 30, 2006 entitled "LED Lighting Fixtures, Inc. Sets World Record at 80 Lumens per Watt for Warm White Fixture".
Press Release from LED Lighting Fixtures dated Nov. 28, 2007 entitled "New Lamp from LED Lighting Fixtures Shatter World Record for Energy Efficiency".
Shimizu, "Development of High-Efficiency LED Downlight", First International Conference on White LEDs and Solid State Lighting, Nov. 30, 2007.
U.S. Department of Energy, "DOE Solid-State Lighting CALiPER Program, Summary of Results: Round 3 of Product Testing," Oct. 2007.
U.S. Department of Energy, "DOE Solid-State Lighting CALiPER Program, Summary of Results: Round 4 of Product Testing," Jan. 2008.
U.S. Department of Energy, "DOE Solid-State Lighting CALiPER Program, Summary of Results: Round 5 of Product Testing," May 2008.
Van De Ven et al., "Warm White Illumination with High CRI and High Efficacy by Combining 455 nm Excited Yellowish Phosphor LEDs and Red A1InGaP LEDs," First International Conference on White LEDs and Solid State Lighting, Nov. 30, 2007.
Optoled Lighting Inc., *OptoLED Product Information*, 2009, Publisher: OptoLED GmBH website: accessed at http://222.optoled.de/englisch/products/led.html.
Permlight Inc., *Enbryten LED Product Information*, Feb. 2005, Publisher: Permlight Inc. website; accessed at http://www.webarchive.org displaying that www.permlight.com/products/LEDfixtures.asp was publicly available Jan. 2004.

* cited by examiner

LIGHTING DEVICE AND LIGHTING METHOD

CROSS-REFERENCE TO RELATED APPLICATIONS

This application claims the benefit of U.S. Provisional Patent Application No. 60/752,555, filed Dec. 21, 2005, the entirety of which is incorporated herein by reference.

FIELD OF THE INVENTION

The present invention relates to a lighting device, in particular, a device which includes one or more solid state light emitters. The present invention also relates to a lighting device which includes one or more solid state light emitters, and which optionally further includes one or more luminescent materials (e.g., one or more phosphors). In a particular aspect, the present invention relates to a lighting device which includes one or more light emitting diodes, and optionally further includes one or more luminescent materials. The present invention is also directed to lighting methods.

BACKGROUND OF THE INVENTION

A large proportion (some estimates are as high as twenty-five percent) of the electricity generated in the United States each year goes to lighting. Accordingly, there is an ongoing need to provide lighting which is more energy-efficient. It is well-known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient as compared to solid state light emitters, such as light emitting diodes.

In addition, as compared to the normal lifetimes of solid state light emitters, incandescent light bulbs have relatively short lifetimes, i.e., typically about 750-1000 hours. In comparison, the lifetime of light emitting diodes, for example, can generally be measured in decades. Fluorescent bulbs have longer lifetimes (e.g., 10,000-20,000 hours) than incandescent lights, but provide less favorable color reproduction. Color reproduction is typically measured using the Color Rendering Index (CRI Ra) which is a relative measure of the shift in surface color of an object when lit by a particular lamp. Daylight has the highest CRI (Ra of 100), with incandescent bulbs being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower).

Another issue faced by conventional light fixtures is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on usage of 6 hours per day for 20 years). Light-producing device lifetime is typically much shorter, thus creating the need for periodic change-outs.

Accordingly, for these and other reasons, efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide light emitting diodes (or other solid state light emitters) which are improved, e.g., with respect to energy efficiency, color rendering index (CRI Ra), contrast, efficacy (lm/W), and/or duration of service.

A variety of solid state light emitters are well-known. For example, one type of solid state light emitter is a light emitting diode. Light emitting diodes are well-known semiconductor devices that convert electrical current into light. A wide variety of light emitting diodes are used in increasingly diverse fields for an ever-expanding range of purposes.

More specifically, light emitting diodes are semiconducting devices that emit light (ultraviolet, visible, or infrared) when a potential difference is applied across a p-n junction structure. There are a number of well-known ways to make light emitting diodes and many associated structures, and the present invention can employ any such devices. By way of example, Chapters 12-14 of Sze, Physics of Semiconductor Devices, (2d Ed. 1981) and Chapter 7 of Sze, Modern Semiconductor Device Physics (1998) describe a variety of photonic devices, including light emitting diodes.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

As is well-known, a light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

Although the development of light emitting diodes has in many ways revolutionized the lighting industry, some of the characteristics of light emitting diodes have presented challenges, some of which have not yet been fully met. For example, the emission spectrum of any particular light emitting diode is typically concentrated around a single wavelength (as dictated by the light emitting diode's composition and structure), which is desirable for some applications, but not desirable for others, (e.g., for providing lighting, such an emission spectrum provides a very low CRI).

Because light that is perceived as white is necessarily a blend of light of two or more colors (or wavelengths), no single light emitting diode junction has been developed that can produce white light. "White" light emitting diode lamps have been produced which have a light emitting diode pixel formed of respective red, green and blue light emitting diodes. Other "white" light emitting diodes have been produced which include (1) a light emitting diode which generates blue light and (2) a luminescent material (e.g., a phosphor) that emits yellow light in response to excitation by light emitted by the light emitting diode, whereby the blue light and the yellow light, when mixed, produce light that is perceived as white light.

In addition, the blending of primary colors to produce combinations of non-primary colors is generally well understood in this and other arts. In general, the 1931 CIE Chromaticity Diagram (an international standard for primary colors established in 1931), and the 1976 CIE Chromaticity Diagram (similar to the 1931 Diagram but modified such that similar distances on the Diagram represent similar perceived differences in color) provide useful reference for defining colors as weighted sums of primary colors.

Light emitting diodes can thus be used individually or in any combinations, optionally together with one or more luminescent material (e.g., phosphors or scintillators) and/or filters, to generate light of any desired perceived color (including white). Accordingly, the areas in which efforts are being made to replace existing light sources with light emitting diode light sources, e.g., to improve energy efficiency, color rendering index (CRI), efficacy (lm/W), and/or duration of service, are not limited to any particular color or color blends of light.

A wide variety of luminescent materials (also known as lumiphors or luminophoric media, e.g., as disclosed in U.S. Pat. No. 6,600,175, the entirety of which is hereby incorporated by reference) are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished by adding the luminescent materials to a clear plastic encapsulant material (e.g., epoxy-based or silicone-based material) as discussed above, for example by a blending or coating process.

For example, U.S. Pat. No. 6,963,166 (Yano '166) discloses that a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. According to Yano '166, the first resin portion is obtained by filling the cup reflector with a resin material and curing it after the light emitting diode chip has been mounted onto the bottom of the cup reflector and then has had its cathode and anode electrodes electrically connected to the leads by way of wires. According to Yano '166, a phosphor is dispersed in the first resin portion so as to be excited with the light A that has been emitted from the light emitting diode chip, the excited phosphor produces fluorescence ("light B") that has a longer wavelength than the light A, a portion of the light A is transmitted through the first resin portion including the phosphor, and as a result, light C, as a mixture of the light A and light B, is used as illumination.

As noted above, "white LED lights" (i.e., lights which are perceived as being white or near-white) have been investigated as potential replacements for white incandescent lamps. A representative example of a white LED lamp includes a package of a blue light emitting diode chip, made of gallium nitride (GaN), coated with a phosphor such as YAG. In such an LED lamp, the blue light emitting diode chip produces an emission with a wavelength of about 450 nm, and the phosphor produces yellow fluorescence with a peak wavelength of about 550 nm on receiving that emission. For instance, in some designs, white light emitting diodes are fabricated by forming a ceramic phosphor layer on the output surface of a blue light-emitting semiconductor light emitting diode. Part of the blue ray emitted from the light emitting diode chip passes through the phosphor, while part of the blue ray emitted from the light emitting diode chip is absorbed by the phosphor, which becomes excited and emits a yellow ray. The part of the blue light emitted by the light emitting diode which is transmitted through the phosphor is mixed with the yellow light emitted by the phosphor. The viewer perceives the mixture of blue and yellow light as white light.

As also noted above, in another type of LED lamp, a light emitting diode chip that emits an ultraviolet ray is combined with phosphor materials that produce red (R), green (G) and blue (B) light rays. In such an "RGB LED lamp", the ultraviolet ray that has been radiated from the light emitting diode chip excites the phosphor, causing the phosphor to emit red, green and blue light rays which, when mixed, are perceived by the human eye as white light. Consequently, white light can also be obtained as a mixture of these light rays.

Designs have been provided in which existing LED component packages and other electronics are assembled into a fixture. In such designs, a packaged LED is mounted to a circuit board, the circuit board is mounted to a heat sink, and the heat sink is mounted to the fixture housing along with required drive electronics. In many cases, additional optics (secondary to the package parts) are also necessary.

In substituting light emitting diodes for other light sources, e.g., incandescent light bulbs, packaged LEDs have been used with conventional light fixtures, for example, fixtures which include a hollow lens and a base plate attached to the lens, the base plate having a conventional socket housing with one or more contacts which are electrically coupled to a power source. For example, LED light bulbs have been constructed which comprise an electrical circuit board, a plurality of packaged LEDs mounted to the circuit board, and a connection post attached to the circuit board and adapted to be connected to the socket housing of the light fixture, whereby the plurality of LEDs can be illuminated by the power source.

There is an ongoing need for ways to use solid state light emitters, e.g., light emitting diodes, to provide white light in a wider variety of applications, with greater energy efficiency, with improved color rendering index (CRI), with improved efficacy (lm/W), and/or with longer duration of service.

BRIEF SUMMARY OF THE INVENTION

There exist "white" LED light sources which are relatively efficient but have a poor color rendering, Ra typically less then 75, and which are particularity deficient in the rendering of red colors and also to a significant extent deficient in green. This means that many things, including the typical human complexion, food items, labeling, painting, posters, signs, apparel, home decoration, plants, flowers, automobiles, etc. exhibit odd or wrong color as compared to being illuminated with an incandescent light or natural daylight. Typically such white LEDs have a color temperature of approximately 5000K, which is generally not visually comfortable for general illumination, which however maybe desirable for the illumination of commercial produce or advertising and printed materials.

Some so-called "warm white" LEDs have a more acceptable color temperature (typically 2700-3500 K) for indoor use, and good CRI (in the case of a yellow and red phosphor mix as high as Ra=95), but their efficiency is much less then half that of the standard "white" LEDs.

Colored objects illuminated by RGB LED lamps sometimes do not appear in their true colors. For example, an object that reflects only yellow light, and thus that appears to be yellow when illuminated with white light, may appear duller and de-emphasized when illuminated with light having an apparent yellow color, produced by the red and green LEDs of an RGB LED fixture. Such fixtures, therefore, are considered to not provide excellent color rendition, particularly when illuminating various settings such as a theater stage, television set, building interior, or display window. In addition, green LEDs are currently inefficient, and thus reduce the efficiency of such lamps.

Employing LEDs having a wide variety of hues would similarly necessitate use of LEDs having a variety of efficiencies, including some with low efficiency, thereby reducing the efficiency of such systems and dramatically increase the complexity and cost of the circuitry to control the many different types of LEDs and maintain the color balance of the light.

There is therefore a need for a high efficiency solid-state white light source that combines the efficiency and long life of white LEDs (i.e., which avoids the use of relatively inefficient light sources) with an acceptable color temperature and good color rendering index, a wide gamut and simple control circuit.

In one aspect of the present invention, illuminations from two or more sources of visible light which, if mixed in the absence of any other light, would produce a combined illumination which would be perceived as white or near-white, are mixed with illumination from one or more additional sources of visible light, and the illumination from the mixture of light thereby produced is on or near the blackbody locus on the 1931 CIE Chromaticity Diagram (or on the 1976 CIE Chromaticity Diagram), each of the sources of visible light being independently selected from among solid state light emitters and luminescent materials.

In the discussion relating to the present invention, the two or more sources of visible light which produce light which, if combined in the absence of any other light, would produce an illumination which would be perceived as white or near-white are referred to herein as "white light generating sources." The one or more additional sources of visible light referred to above are referred to herein as "additional light sources."

The individual additional light sources can be saturated or non-saturated. The term "saturated", as used herein, means having a purity of at least 85%, the term "purity" having a well-known meaning to persons skilled in the art, and procedures for calculating purity being well-known to those of skill in the art.

In another aspect of the present invention, there are provided lighting devices in which a "white" light source (i.e., a source which produces light which is perceived by the human eye as being white or near-white) having a poor CRI (e.g., 75 or less) is combined with one or more other sources of light, in order to spectrally enhance (i.e., to increase the CRI) the light from the white light source.

Aspects of the present invention can be represented on either the 1931 CIE (Commission International de I'Eclairage) Chromaticity Diagram or the 1976 CIE Chromaticity Diagram. FIG. 1 shows the 1931 CIE Chromaticity Diagram. FIG. 2 shows the 1976 Chromaticity Diagram. FIG. 3 shows an enlarged portion of the 1976 Chromaticity Diagram, in order to show the blackbody locus in more detail. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). For a technical description of CIE chromaticity diagrams, see, for example, "Encyclopedia of Physical Science and Technology", vol. 7, 230-231 (Robert A Meyers ed., 1987). The spectral colors are distributed around the edge of the outlined space, which includes all of the hues perceived by the human eye. The boundary line represents maximum saturation for the spectral colors. As noted above, the 1976 CIE Chromaticity Diagram is similar to the 1931 Diagram, except that the 1976 Diagram has been modified such that similar distances on the Diagram represent similar perceived differences in color.

In the 1931 Diagram, deviation from a point on the Diagram can be expressed either in terms of the coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues which would each be perceived as differing from the specified hue to a common extent (and likewise for loci of points defined as being spaced from a particular hue by other quantities of MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$, and the hues defined by a locus of points which are each a common distance from a specified hue consist of hues which would each be perceived as differing from the specified hue to a common extent.

The chromaticity coordinates and the CIE chromaticity diagrams illustrated in FIGS. 1-3 are explained in detail in a number of books and other publications, such as pages 98-107 of K. H. Butler, "Fluorescent Lamp Phosphors" (The Pennsylvania State University Press 1980) and pages 109-110 of G. Blasse et al., "Luminescent Materials" (Springer-Verlag 1994), both incorporated herein by reference.

The chromaticity coordinates (i.e., color points) that lie along the blackbody locus obey Planck's equation: $E(\lambda)=A\lambda^{-5}/(e^{(B/T)}-1)$, where E is the emission intensity, $\lambda$ is the emission wavelength, T the color temperature of the blackbody and A and B are constants. Color coordinates that lie on or near the blackbody locus yield pleasing white light to a human observer. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants which produce light which is on or near the blackbody locus can thus be described in terms of their color temperature.

Also depicted on the 1976 CIE Diagram are designations A, B, C, D and E, which refer to light produced by several standard illuminants correspondingly identified as illuminants A, B, C, D and E, respectively.

CRI is a relative measurement of how the color rendition of an illumination system compares to that of a blackbody radiator or other defined reference. The CRI Ra equals 100 if the color coordinates of a set of test colors being illuminated by the illumination system are the same as the coordinates of the same test colors being irradiated by the reference radiator.

In accordance with an aspect of the present invention, there is provided a lighting device comprising:

a plurality of sources of visible light, the sources of visible light each being independently selected from among solid state light emitters and luminescent materials, each source of visible light, when illuminated, emitting light of a hue, the sources of visible light, when illuminated, emitting in total not more than four different hues, the sources of visible light comprising a first group of sources of visible light and a second group of sources of visible light, the first group of sources of visible light comprising sources of visible light which, when illuminated, emit light of two hues which, if mixed in the absence of any other light, produce a first group mixed illumination as noted above, i.e., which would be perceived as white or near-white, and/or would have color coordinates (x,y) which are within an area on a 1931 CIE Chromaticity Diagram defined by five points having the following (x,y) coordinates: point 1—(0.59, 0.24); point 2—(0.40, 0.50); point 3—(0.24, 0.53); point 4—(0.17, 0.25); and point 5—(0.30, 0.12), i.e., the first group mixed illumination would have color coordinates (x,y) within an area defined by a line segment connecting point 1 to point 2, a line segment connecting point 2 to point 3, a line segment connecting point 3 to point 4, a line segment connecting point 4 to point 5, and a line segment connecting point 5 to point 1, the second group of sources of visible light comprising one or more one sources of visible light of a first hue, and optionally also one or more sources of visible light of a second hue, wherein mixing of light from the first group of sources of visible light and light from the second group of sources of visible light produces a first group-second group mixed illumination of a hue which is within ten MacAdam ellipses (or, in some embodiments, within six MacAdam ellipses, or, in some embodiments, within three MacAdam ellipses) of at least one point on a blackbody locus on the 1931 CIE Chromaticity Diagram.

In this aspect of the invention, the first group mixed illumination can instead be characterized by the corresponding values for u' and v' on a 1976 CIE Chromaticity Diagram, i.e., the first group mixed illumination would be perceived as white or near-white, and/or would have color coordinates (u',v') which are within an area on a 1976 CIE Chromaticity Diagram defined by five points having the following (u',v') coordinates: point 1—(0.50, 0.46); point 2—(0.20, 0.55); point 3—(0.11, 0.54); point 4—(0.12, 0.39); and point 5—(0.32, 0.28).

For example, in a specific embodiment, light provided at point 2 can have a dominant wavelength of 569 nm and a purity of 67%; light provided at point 3 can have a dominant wavelength of 522 nm and a purity of 38%; light provided at point 4 can have a dominant wavelength of 485 nm and a purity of 62%; and light provided at point 5 can have a purity of 20%.

In some embodiments within this aspect of the present invention, the first group mixed illumination would have color coordinates (x,y) which are within an area on a 1931 CIE Chromaticity Diagram defined by four points having the following (x,y) coordinates: point 1—(0.41, 0.45); point 2—(0.37, 0.47); point 3—(0.25, 0.27); and point 4—(0.29, 0.24), (i.e., the first group mixed illumination would have color coordinates (u',v') which are within an area on a 1976 CIE Chromaticity Diagram defined by four points having the following (u',v') coordinates: point 1—(0.22, 0.53); point 2—(0.19, 0.54); point 3—(0.17, 0.42); and point 4—(0.21, 0.41))—for example, in a specific embodiment, light provided at point 1 can have a dominant wavelength of 573 nm and a purity of 57%; light provided at point 2 can have a dominant wavelength of 565 nm and a purity of 48%; light provided at point 3 can have a dominant wavelength of 482 nm and a purity of 33%; and light provided at point 4 can have a dominant wavelength of 446 nm and a purity of 28%.

In some embodiments within this aspect of the invention, a combined intensity of light from the first group of sources of visible light is at least 60% (in some embodiments at least 70%) of an intensity of the first group-second group mixed illumination.

In accordance with another aspect of the present invention, there is provided a lighting device comprising:

a plurality of sources of visible light, the sources of visible light each being independently selected from among solid state emitters and luminescent materials, each of the sources of visible light, when illuminated, emitting light of a hue, the sources of visible light, when illuminated, emitting in total at least three different hues, the sources of visible light comprising a first group of sources of visible light and a second group of sources of visible light, the first group of sources of visible light comprising sources of visible light which, when illuminated, emit light of at least two hues which, if mixed in the absence of any other light, produce a first group mixed illumination which would be perceived as white or near-white, and/or would have color coordinates (x,y) which are within an area on a 1931 CIE Chromaticity Diagram defined by five points having the following (x,y) coordinates: point 1—(0.59, 0.24); point 2—(0.40, 0.50); point 3—(0.24, 0.53); point 4—(0.17, 0.25); and point 5—(0.30, 0.12), the second group of sources of visible light comprising at least one additional source of visible light, wherein mixing of light from the first group of sources of visible light and light from the second group of sources of visible light produces a first group-second group mixed illumination of a hue which is within ten MacAdam ellipses (or, in some embodiments, within six MacAdam ellipses, or, in some embodiments, within three MacAdam ellipses) of at least one point on a blackbody locus on said 1931 CIE Chromaticity Diagram, and wherein an intensity of at least one of the hues is at least 35% of an intensity of the first group-second group mixed illumination.

The expression "intensity" is used herein in accordance with its normal usage, i.e., to refer to the amount of light produced over a given area, and is measured in units such as lumens or candelas.

In this aspect of the invention, the first group mixed illumination can instead be characterized by the corresponding values for u' and v' on a 1976 CIE Chromaticity Diagram, i.e., the first group mixed illumination which would be perceived as white or near-white, and/or would have color coordinates (u',v') which are within an area on a 1976 CIE Chromaticity Diagram defined by five points having the following (u',v') coordinates: point 1—(0.50, 0.46); point 2—(0.20, 0.55); point 3—(0.11, 0.54); point 4—(0.12, 0.39); and point 5—(0.32, 0.28).

In some embodiments within this aspect of the present invention, the first group mixed illumination would have color coordinates (x,y) which are within an area on a 1931 CIE Chromaticity Diagram defined by four points having the following (x,y) coordinates: point 1—(0.41, 0.45); point 2—(0.37, 0.47); point 3—(0.25, 0.27); and point 4—(0.29, 0.24), (i.e., the first group mixed illumination would have color coordinates (u',v') which are within an area on a 1976 CIE Chromaticity Diagram defined by four points having the following (u',v') coordinates: point 1—(0.22, 0.53); point 2—(0.19, 0.54); point 3—(0.17, 0.42); and point 4—(0.21, 0.41))—for example, in a specific embodiment, light provided at point 1 can have a dominant wavelength of 573 nm and a purity of 57%; light provided at point 2 can have a dominant wavelength of 565 nm and a purity of 48%; light provided at point 3 can have a dominant wavelength of 482 nm and a purity of 33%; and light provided at point 4 can have a dominant wavelength of 446 nm and a purity of 28%.

In some embodiments within this aspect of the invention, a combined intensity of light from the first group of sources of visible light is at least 60% (in some embodiments at least 70%) of an intensity of the first group-second group mixed illumination.

In particular embodiments of the present invention, at least one of the sources of visible light is a solid state light emitter.

In particular embodiments of the present invention, at least one of the sources of visible light is a light emitting diode.

In particular embodiments of the present invention, at least one of the sources of visible light is a luminescent material.

In particular embodiments of the present invention, at least one of the sources of visible light is a phosphor.

In particular embodiments of the present invention, at least one of the sources of visible light is a light emitting diode and at least one of the sources of visible light is a luminescent material.

In particular embodiments of the present invention, an intensity of the first group mixed illumination is at least 75% of an intensity of the first group-second-group mixed illumination.

In accordance with another aspect of the present invention, there is provided a lighting device comprising:

at least one white light source having a CRI of 75 or less, and at least one additional source of visible light consisting of at least one additional source of visible light of a first additional hue, the at least one additional source of visible light being selected from among solid state light emitters and luminescent materials, wherein mixing of light from the white light source and light from the at least one additional source of visible light produces a mixed illumination which has a CRI of greater than 75.

In some embodiments within this aspect of the present invention, the combined intensity of light from the at least one white light source is at least 50% (in some embodiments at least 75%) of the intensity of the mixed illumination.

In accordance with another aspect of the present invention, there is provided a lighting device comprising:

at least one white light source having a CRI of 75 or less, and additional sources of visible light consisting of at least one additional source of visible light of a first additional hue and at least one additional source of visible light of a second additional hue, the additional sources of visible light being selected from among solid state light emitters and luminescent materials, wherein mixing of light from the white light source and light from the additional sources of visible light produces a mixed illumination which has a CRI of greater than 75.

In some embodiments within this aspect of the present invention, the combined intensity of light from the at least one white light source is at least 50% (in some embodiments at least 75%) of the intensity of the mixed illumination.

In accordance with another aspect of the present invention, there is provided a method of lighting, comprising:

mixing light from a plurality of sources of visible light, the sources of visible light each being independently selected from among solid state light emitters and luminescent materials, each source of visible light, when illuminated, emitting light of a hue, the sources of visible light, when illuminated, emitting in total three different hues, the sources of visible light comprising a first group of sources of visible light and a second group of sources of visible light, the first group of sources of visible light comprising sources of visible light which, when illuminated, emit light of two hues which, if mixed in the absence of any other light, produce a first group mixed illumination which would have x,y color coordinates which are within an area on a 1931 CIE Chromaticity Diagram defined by five points having x,y coordinates: 0.59, 0.24; 0.40, 0.50; 0.24, 0.53; 0.17, 0.25; and 0.30, 0.12, the second group of sources of visible light consisting of at least one source of visible light of a first additional hue, wherein mixing of light from the first group of sources of visible light and light from the second group of sources of visible light produces a first group-second group mixed illumination of a hue which is within ten MacAdam ellipses (or, in some embodiments, within six MacAdam ellipses, or, in some embodiments, within three MacAdam ellipses) of at least one point on a blackbody locus on the 1931 CIE Chromaticity Diagram.

In some embodiments within this aspect of the present invention, the first group mixed illumination would have color coordinates (x,y) which are within an area on a 1931 CIE Chromaticity Diagram defined by four points having the following (x,y) coordinates: point 1—(0.41, 0.45); point 2—(0.37, 0.47); point 3—(0.25, 0.27); and point 4—(0.29, 0.24).

In some embodiments within this aspect of the invention, a combined intensity of light from the first group of sources of visible light is at least 60% (in some embodiments at least 70%) of an intensity of the first group-second group mixed illumination.

In accordance with another aspect of the present invention, there is provided a method of lighting, comprising:

mixing light from a plurality of sources of visible light, the sources of visible light each being independently selected from among solid state light emitters and luminescent materials, each source of visible light, when illuminated, emitting light of a hue, the sources of visible light, when illuminated, emitting in total four different hues, the sources of visible light comprising a first group of sources of visible light and a second group of sources of visible light, the first group of sources of visible light comprising sources of visible light which, when illuminated, emit light of two hues which, if mixed in the absence of any other light, produce a first group mixed illumination which would have x,y color coordinates which are within an area on a 1931 CIE Chromaticity Diagram defined by five points having x,y coordinates: 0.59, 0.24; 0.40, 0.50; 0.24, 0.53; 0.17, 0.25; and 0.30, 0.12, the second group of sources of visible light consisting of at least one source of visible light of a first additional hue and at least one source of visible light of a second additional hue;

wherein mixing of light from the first group of sources of visible light and light from the second group of sources of visible light produces a first group-second group mixed illumination of a hue which is within ten MacAdam ellipses (or, in some embodiments, within six MacAdam ellipses, or, in some embodiments, within three MacAdam ellipses) of at least one point on a blackbody locus on the 1931 CIE Chromaticity Diagram.

In some embodiments within this aspect of the present invention, the first group mixed illumination would have color coordinates (x,y) which are within an area on a 1931 CIE Chromaticity Diagram defined by four points having the following (x,y) coordinates: point 1—(0.41, 0.45); point 2—(0.37, 0.47); point 3—(0.25, 0.27); and point 4—(0.29, 0.24).

In some embodiments within this aspect of the invention, a combined intensity of light from the first group of sources of visible light is at least 60% (in some embodiments at least 70%) of an intensity of the first group-second group mixed illumination.

In accordance with another aspect of the present invention, there is provided a method of lighting, comprising:

mixing light from a plurality of sources of visible light, the sources of visible light each being independently selected from among solid state emitters and luminescent materials, each of the sources of visible light, when illuminated, emitting light of a hue, the sources of visible light, when illuminated, emitting in total at least three different hues, the sources of visible light comprising a first group of sources of visible light and a second group of sources of visible light, the first group of sources of visible light comprising sources of visible light which, when illuminated, emit light of at least two hues which, if mixed in the absence of any other light, produce a first group mixed illumination which would have color x,y coordinates which are within an area on a 1931 CIE Chromaticity Diagram defined by five points having x,y coordinates: 0.59, 0.24; 0.40, 0.50; 0.24, 0.53; 0.17, 0.25; and 0.30, 0.12, the second group of sources of visible light comprising at least one additional source of visible light, wherein mixing of light from the first group of sources of visible light and light from the second group of sources of visible light produces a first group-second group mixed illumination of a hue which is within ten MacAdam ellipses (or, in some embodiments, within six MacAdam ellipses, or, in some embodiments, within three MacAdam ellipses) of at least one point on a blackbody locus on the 1931 CIE Chromaticity Diagram, and wherein an intensity of at least one of the hues is at least 35% of an intensity of the first group-second group mixed illumination.

In some embodiments within this aspect of the present invention, the first group mixed illumination would have color coordinates (x,y) which are within an area on a 1931 CIE Chromaticity Diagram defined by four points having the following (x,y) coordinates: point 1—(0.41, 0.45); point 2—(0.37, 0.47); point 3—(0.25, 0.27); and point 4—(0.29, 0.24).

In some embodiments within this aspect of the invention, a combined intensity of light from the first group of sources of visible light is at least 60% (in some embodiments at least 70%) of an intensity of the first group-second group mixed illumination.

In accordance with another aspect of the present invention, there is provided a method of lighting, comprising:

mixing light from at least one white light source having a CRI of 75 or less, and light from at least one additional source of visible light consisting of at least one additional source of visible light of a first additional hue, the at least one additional source of visible light being selected from among solid state light emitters and luminescent materials, wherein mixing of light from the white light source and light from the at least one additional source of visible light produces a mixed illumination which has a CRI of greater than 75.

In some embodiments within this aspect of the present invention, the combined intensity of light from the at least one white light source is at least 50% (in some embodiments at least 75%) of the intensity of the mixed illumination.

In accordance with another aspect of the present invention, there is provided a method of lighting, comprising:

mixing light from at least one white light source having a CRI of 75 or less, and light from additional sources of visible light consisting of at least one additional source of visible light of a first additional hue and at least one additional source of visible light of a second additional hue, the additional sources of visible light being selected from among solid state light emitters and luminescent materials, wherein mixing of light from the white light source and light from the additional sources of visible light produces a mixed illumination which has a CRI of greater than 75.

In some embodiments within this aspect of the present invention, the combined intensity of light from the at least one white light source is at least 50% (in some embodiments at least 75%) of the intensity of the mixed illumination.

The present invention may be more fully understood with reference to the accompanying drawings and the following detailed description of the invention.

BRIEF DESCRIPTION OF THE DRAWING FIGURES

DETAILED DESCRIPTION OF THE INVENTION

Figure 1:
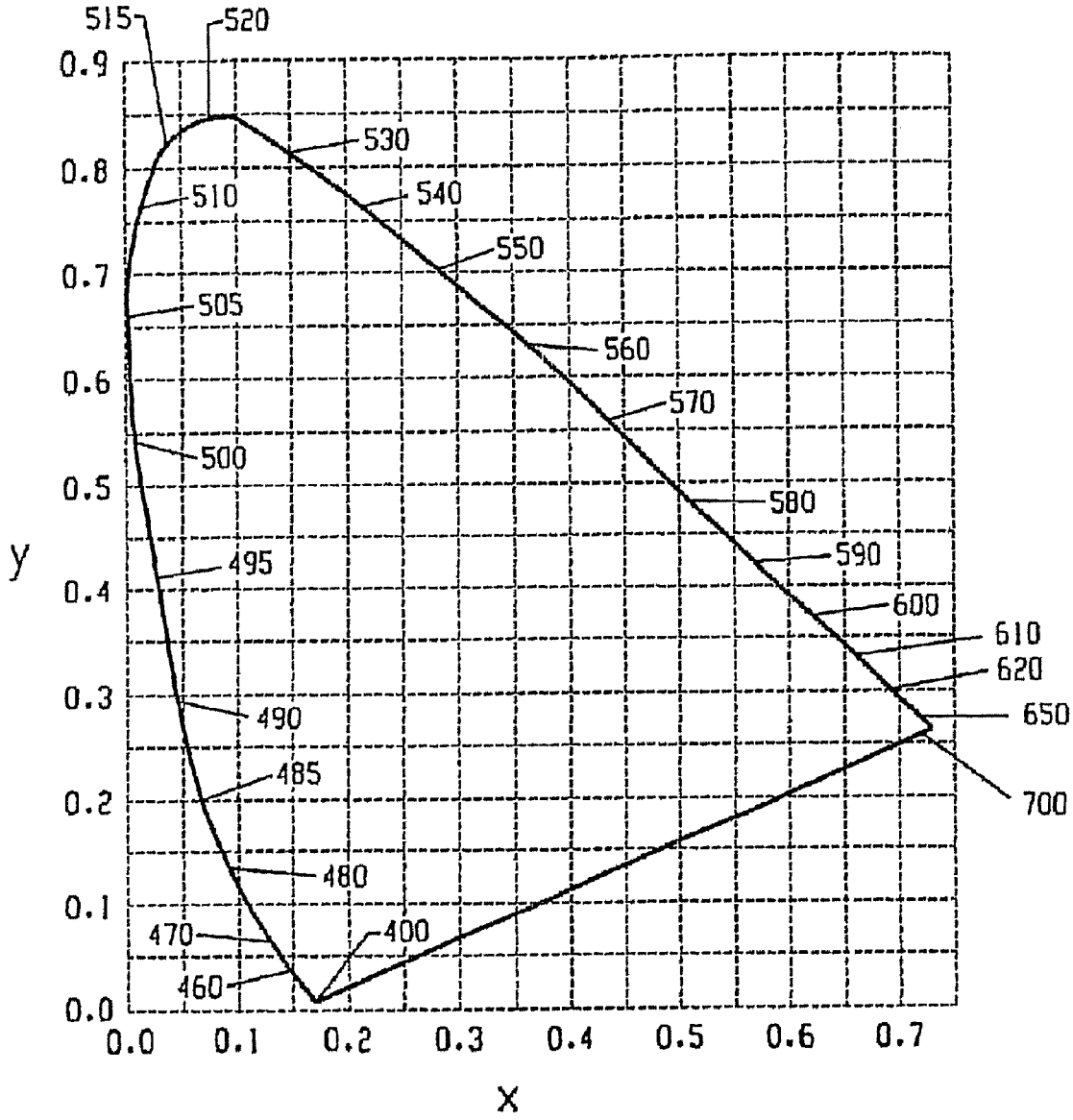
FIG. 1 shows the 1931 CIE Chromaticity Diagram.
Figure 2:
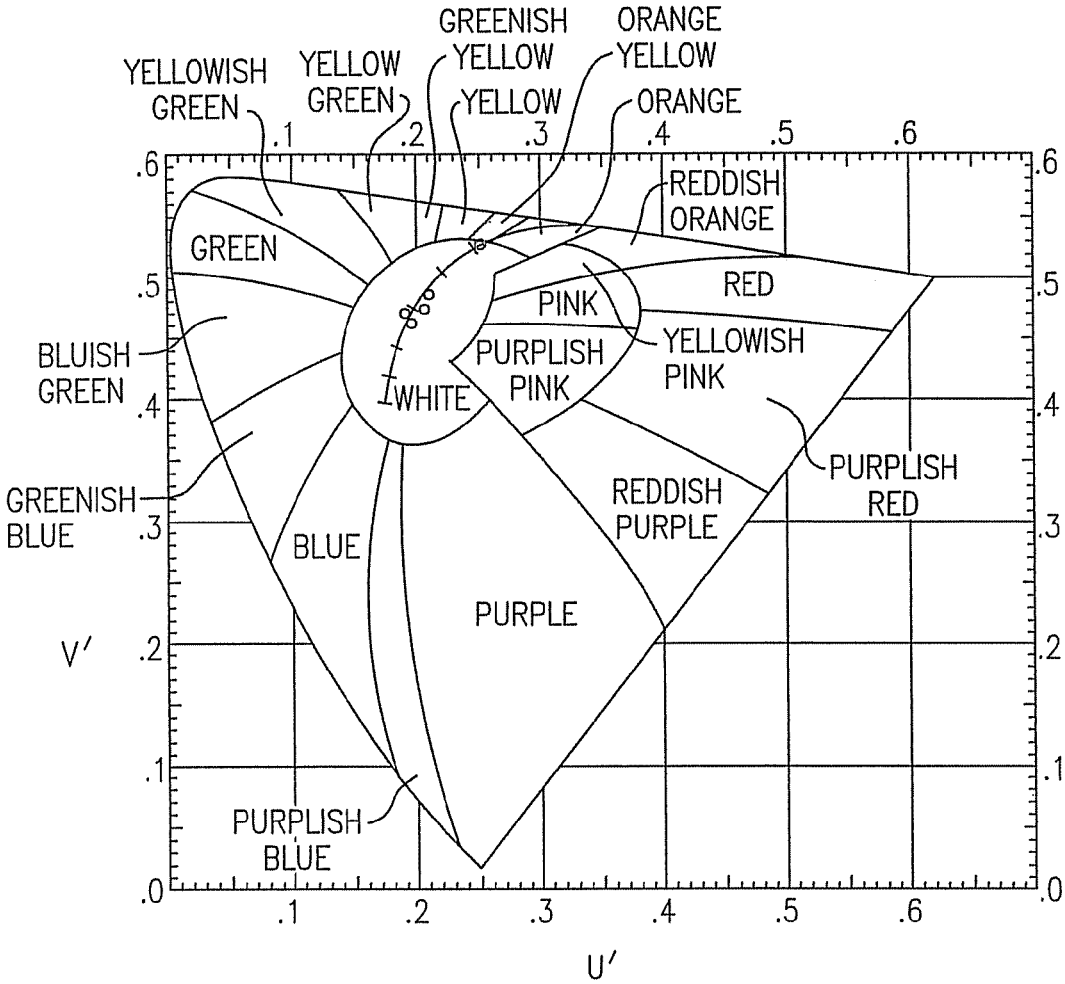
FIG. 2 shows the 1976 Chromaticity Diagram.
Figure 3:
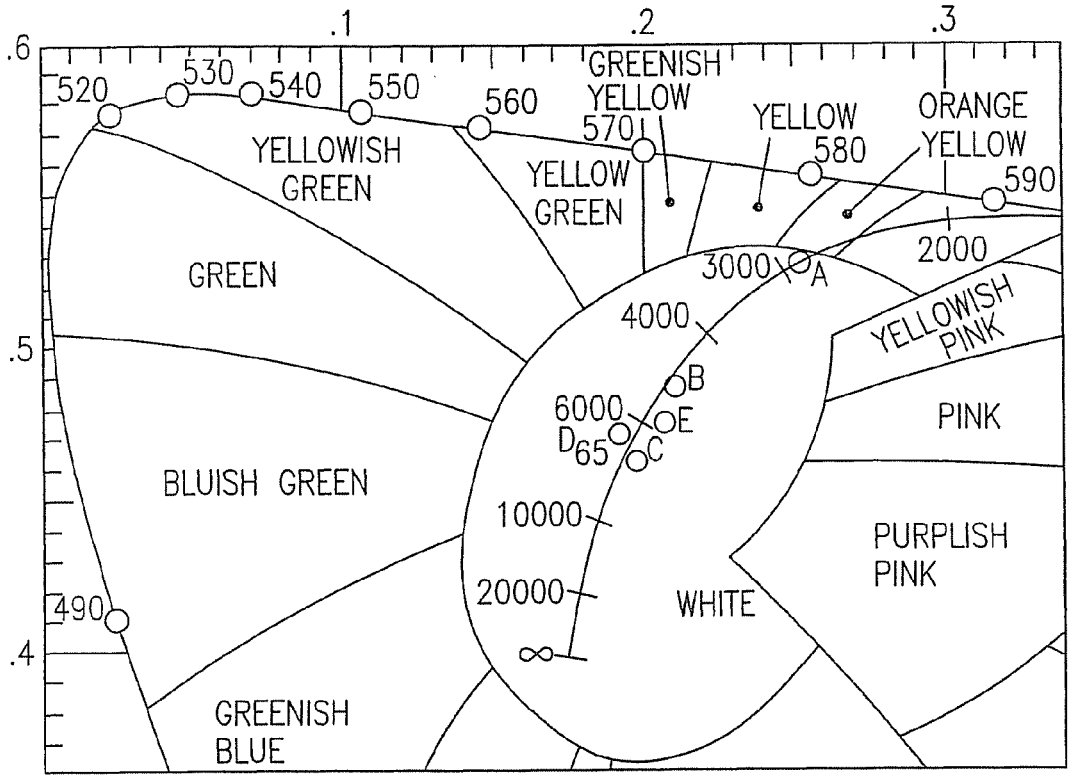
FIG. 3 shows an enlarged portion of the 1976 Chromaticity Diagram, in order to show the blackbody locus in detail.

As noted above, in one aspect of the present invention, there are provided lighting devices in which a "white" light source (i.e., a source which produces light which is perceived by the human eye as being white or near-white) having a poor CRI (e.g., 75 or less) is combined with one or more other sources of light, in order to spectrally enhance (i.e., to increase the CRI) the light from the white light source.

As noted above, in another aspect of the present invention, illuminations from two or more sources of visible light which, if mixed in the absence of any other light, would produce a combined illumination which would be perceived as white or near-white, is mixed with illumination from one or more additional sources of visible light, the respective sources of visible light each being independently selected from among solid state light emitters and luminescent materials.

Skilled artisans are familiar with a wide variety of "white" light sources which have poor CRI, and any such sources can be used according to the present invention. For example, such "white" light sources include metal halide lights, sodium lights, discharge lamps, and some fluorescent lights.

Any desired solid state light emitter or emitters can be employed in accordance with the present invention. Persons of skill in the art are aware of, and have ready access to, a wide variety of such emitters. Such solid state light emitters include inorganic and organic light emitters. Examples of types of such light emitters include light emitting diodes (inorganic or organic), laser diodes and thin film electroluminescent devices, a variety of each of which are well-known in the art.

As noted above, persons skilled in the art are familiar with a wide variety of solid state light emitters, including a wide variety of light emitting diodes, a wide variety of laser diodes and a wide variety of thin film electroluminescent devices, and therefore it is not necessary to describe in detail such devices, and/or the materials out of which such devices are made.

As indicated above, the lighting devices according to the present invention can comprise any desired number of solid state emitters. For example, a lighting device according to the present invention can include 50 or more light emitting diodes, or can include 100 or more light emitting diodes, etc. In general, with current light emitting diodes, greater efficiency can be achieved by using a greater number of smaller light emitting diodes (e.g., 100 light emitting diodes each having a surface area of 0.1 $mm^2$ vs. 25 light emitting diodes each having a surface area of 0.4 $mm^2$ but otherwise being identical).

Analogously, light emitting diodes which operate at lower current densities are generally more efficient. Light emitting diodes which draw any particular current can be used according to the present invention. In one aspect of the present invention, light emitting diodes which each draw not more than 50 milliamps are employed.

The one or more luminescent materials, if present, can be any desired luminescent material. As noted above, persons skilled in the art are familiar with, and have ready access to, a wide variety of luminescent materials. The one or more luminescent materials can be down-converting or up-converting, or can include a combination of both types.

For example, the one or more luminescent materials can be selected from among phosphors, scintillators, day glow tapes, inks which glow in the visible spectrum upon illumination with ultraviolet light, etc.

The one or more luminescent materials, when provided, can be provided in any desired form. For example, the luminescent element can be embedded in a resin (i.e., a polymeric matrix), such as a silicone material or an epoxy.

The sources of visible light in the lighting devices of the present invention can be arranged, mounted and supplied with electricity in any desired manner, and can be mounted on any desired housing or fixture. Skilled artisans are familiar with a wide variety of arrangements, mounting schemes, power supplying apparatuses, housings and fixtures, and any such arrangements, schemes, apparatuses, housings and fixtures can be employed in connection with the present invention. The lighting devices of the present invention can be electrically connected (or selectively connected) to any desired power source, persons of skill in the art being familiar with a variety of such power sources.

Figure 4:
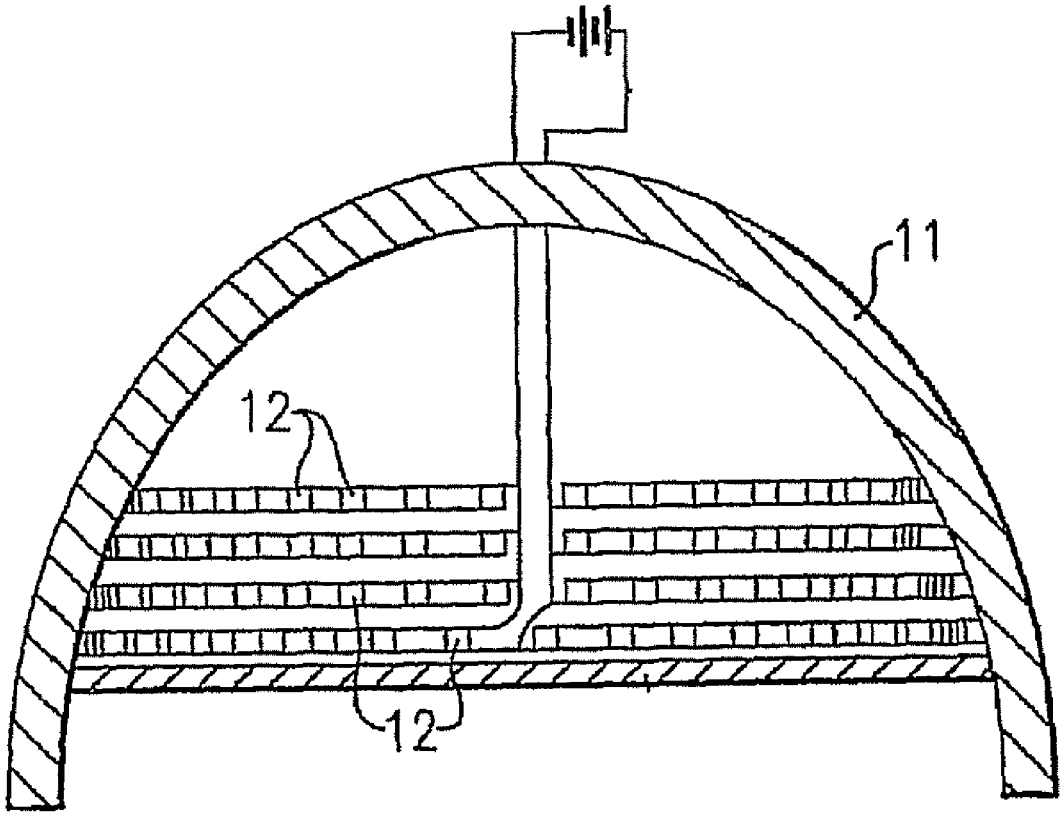
FIG. 4 shows a lighting device in accordance with the present invention.

Representative examples of arrangements of sources of visible light, schemes for mounting sources of visible light, apparatus for supplying electricity to sources of visible light, housings for sources of visible light, fixtures for sources of visible light and power supplies for sources of visible light, all of which are suitable for the lighting devices of the present invention, are described in U.S. Patent Application No. 60/752,753, filed Dec. 21, 2005, entitled "Lighting Device" (inventors: Gerald H. Negley, Antony Paul Van de Ven and Neal Hunter), the entirety of which is hereby incorporated by reference. FIG. 4 depicts a lighting device disclosed in U.S. Patent Application Ser. No. 60/752,753. The lighting device shown in FIG. 4 comprises solid state light emitters 12 mounted on a housing 11.

The devices according to the present invention can further comprise one or more long-life cooling device (e.g., a fan with an extremely high lifetime). Such long-life cooling device(s) can comprise piezoelectric or magnetorestrictive materials (e.g., MR, GMR, and/or HMR materials) that move air as a "Chinese fan". In cooling the devices according to the present invention, typically only enough air to break the boundary layer is required to induce temperature drops of 10 to 15 degrees C. Hence, in such cases, strong "breezes" or a large fluid flow rate (large CFM) are typically not required (thereby avoiding the need for conventional fans).

The devices according to the present invention can further comprise secondary optics to further change the projected nature of the emitted light. Such secondary optics are well-known to those skilled in the art, and so they do not need to be described in detail herein—any such secondary optics can, if desired, be employed.

The devices according to the present invention can further comprise sensors or charging devices or cameras, etc. For example, persons of skill in the art are familiar with, and have ready access to, devices which detect one or more occurrence (e.g., motion detectors, which detect motion of an object or person), and which, in response to such detection, trigger illumination of a light, activation of a security camera, etc. As a representative example, a device according to the present invention can include a lighting device according to the present invention and a motion sensor, and can be constructed such that (1) while the light is illuminated, if the motion sensor detects movement, a security camera is activated to record visual data at or around the location of the detected motion, or (2) if the motion sensor detects movement, the light is illuminated to light the region near the location of the detected motion and the security camera is activated to record visual data at or around the location of the detected motion, etc.

For indoor residential illumination a color temperature of 2700 k to 3300 k is normally preferred, and for outdoor flood lighting of colorful scenes a color temperature approximating daylight 5000K (4500-6500K) is preferred.

It is preferred that the monochromatic light elements are also light emitting diodes and can be chosen from the range of available colors including red, orange, amber, yellow, green, cyan or blue LEDs.

The following are brief descriptions of a number of representative embodiments in accordance with the present invention:

(1) combining a high efficiency "standard" (6500 k) white with other colors such as red and/or orange to make the color warmer (a cooler color temperature) and to increase the CRI (color rendering index) over standard white LEDs and also over "warm white" LEDs (typically 2700-3300K);

(2) combining a very yellowish white LED (basically blue LED plus phosphor arrangement but with "too much" yellow phosphor) and a red or orange LED to produce a "warm white" color with a high CRI (such a device was tested and found to work well with CRI of >85 and warm white color temperatures (~2700K) and on the blackbody locus;

(3) combining a standard white LED in the range 5500K to 10,000K with red and cyan LEDs (such a device was tested and found to exhibit a CRI of >90);

(4) combining yellow white and red for a residential warm white light fixture;

(5) combining standard white plus red plus cyan for a "daylight white" flood light;

(6) combining light from one or more substantially monochromatic light emitting elements with substantially white light emitting elements with a color temperature suitable for the object being illuminated and having a CRI of greater then 85;

(7) using a substantially white emitter (e.g., an InGaN light emitting diode of a blue color in the range from 440 nm to 480 nm) to excite a phosphorescent material which emits generally yellow light in the green through red portion of the spectrum and such that a portion of the blue light is mixed with the excited light to make white light;

(8) combining a yellowish-white LED having a CIE 1931 xy of approximately 0.37, 0.44 with an orange or red LED in the range 600 nm to 700 nm to produce a light for indoor lighting in the range of 1800 to 4000 k color temperature—for example, combining the sources in a lumen ratio of 73% for white and 27% for orange produces a warm white light source with a high efficiency and high CRI;

(9) combining standard white LEDs (e.g., about 6500 K) with cyan and red LEDs (the cyan and red can be combined into a single binary complementary device or used separately)—combining the red, cyan and white in the proportions of 10%, 13% and 77% respectively produces a daylight like white light with a very high color rendering index, suitable for illumination of objects outside (which are typically colored for viewing in natural daylight a higher color temperature such as 5000K);

(10) combining daylight-white in a WRC (white red cyan) provides a much larger gamut than is available with printing in the CMYK inks and is therefore excellent for the illumination of outdoor printed matter including billboards.

Any two or more structural parts of the lighting devices described herein can be integrated. Any structural part of the lighting devices described herein can be provided in two or more parts (which can be held together, if necessary).

The invention claimed is:

1. A lighting device comprising:

a plurality of sources of visible light, said sources of visible light each being independently selected from among solid state light emitters and luminescent materials, each source of visible light, when illuminated, emitting light of a hue, said sources of visible light, when illuminated, emitting in total three different hues, said sources of visible light comprising a first group of sources of visible light and a second group of sources of visible light, said first group of sources of visible light comprising sources of visible light which, when illuminated, emit light of two hues which, if mixed in the absence of any other light, produce a first group mixed illumination which would have x,y color coordinates which are within an area on a 1931 CIE Chromaticity Diagram defined by five points having x,y coordinates: 0.59, 0.24; 0.40, 0.50; 0.24, 0.53; 0.17, 0.25; and 0.30, 0.12, said second group of sources of visible light comprising at least one source of visible light of a first additional hue, wherein mixing of light from said first group of sources of visible light and light from said second group of sources of visible light produces a first group-second group mixed illumination of a hue which is within ten MacAdam ellipses of at least one point on a blackbody locus on said 1931 CIE Chromaticity Diagram.

2. A lighting device as recited in claim 1, wherein said first group mixed illumination would have x,y color coordinates which are within an area on a 1931 CIE Chromaticity Diagram defined by four points having x,y coordinates: 0.41, 0.45; 0.37, 0.47; 0.25, 0.27; and 0.29, 0.24.

3. A lighting device as recited in claim 1, wherein mixing of light from said first group of sources of visible light and light from said second group of sources of visible light produces a first group-second group mixed illumination of a hue which is within six MacAdam ellipses of at least one point on a blackbody locus on said 1931 CIE Chromaticity Diagram.

4. A lighting device as recited in claim 1, wherein mixing of light from said first group of sources of visible light and light from said second group of sources of visible light produces a first group-second group mixed illumination of a hue which is within three MacAdam ellipses of at least one point on a blackbody locus on said 1931 CIE Chromaticity Diagram.

5. A lighting device as recited in claim 1, wherein said first group-second group mixed illumination has a CRI of at least 85.

6. A lighting device as recited in claim 1, wherein said first group-second group mixed illumination has a CRI of at least 90.

7. A lighting device as recited in claim 1, wherein a combined intensity of said light from said first group of sources of visible light is at least 60% of an intensity of said first group-second group mixed illumination.

8. A lighting device as recited in claim 1, wherein a combined intensity of said light from said first group of sources of visible light is at least 70% of an intensity of said first group-second group mixed illumination.

9. A lighting device as recited in claim 1, wherein said at least one source of visible light of a first additional hue is a solid state light emitter.

10. A lighting device as recited in claim 1, wherein said at least one source of visible light of a first additional hue is a light emitting diode.

11. A lighting device as recited in claim 1, wherein said at least one source of visible light of a first additional hue is a luminescent material.

12. A lighting device as recited in claim 1, wherein said at least one source of visible light of a first additional hue is a phosphor.

13. A lighting device as recited in claim 1, wherein said at least one source of visible light of a first additional hue is saturated.

14. A lighting device comprising:

a plurality of sources of visible light, said sources of visible light each being independently selected from among solid state light emitters and luminescent materials, each source of visible light, when illuminated, emitting light of a hue, said sources of visible light, when illuminated, emitting in total four different hues, said sources of visible light comprising a first group of sources of visible light and a second group of sources of visible light, said first group of sources of visible light comprising sources of visible light which, when illuminated, emit light of two hues which, if mixed in the absence of any other light, produce a first group mixed illumination which would have x,y color coordinates which are within an area on a 1931 CIE Chromaticity Diagram defined by five points having x,y coordinates: 0.59, 0.24; 0.40, 0.50; 0.24, 0.53; 0.17, 0.25; and 0.30, 0.12, said second group of sources of visible light comprising at least one source of visible light of a first additional hue and at least one source of visible light of a second additional hue;

wherein mixing of light from said first group of sources of visible light and light from said second group of sources of visible light produces a first group-second group mixed illumination of a hue which is within ten Mac- Adam ellipses of at least one point on a blackbody locus on said 1931 CIE Chromaticity Diagram.

15. A lighting device as recited in claim 14, wherein said first group mixed illumination would have x,y color coordinates which are within an area on a 1931 CIE Chromaticity Diagram defined by four points having x,y coordinates: 0.41, 0.45; 0.37, 0.47; 0.25, 0.27; and 0.29, 0.24.

16. A lighting device as recited in claim 14, wherein mixing of light from said first group of sources of visible light and light from said second group of sources of visible light produces a first group-second group mixed illumination of a hue which is within six MacAdam ellipses of at least one point on a blackbody locus on said 1931 CIE Chromaticity Diagram.

17. A lighting device as recited in claim 14, wherein mixing of light from said first group of sources of visible light and light from said second group of sources of visible light produces a first group-second group mixed illumination of a hue which is within three MacAdam ellipses of at least one point on a blackbody locus on said 1931 CIE Chromaticity Diagram.

18. A lighting device as recited in claim 14, wherein said first group-second group mixed illumination has a CRI of at least 85.

19. A lighting device as recited in claim 14, wherein said first group-second group mixed illumination has a CRI of at least 90.

20. A lighting device as recited in claim 14, wherein a combined intensity of said light from said first group of sources of visible light is at least 60% of an intensity of said first group-second group mixed illumination.

21. A lighting device as recited in claim 14, wherein a combined intensity of said light from said first group of sources of visible light is at least 70% of an intensity of said first group-second group mixed illumination.

22. A lighting device as recited in claim 14, wherein said at least one source of visible light of a first additional hue is a solid state light emitter.

23. A lighting device as recited in claim 14, wherein said at least one source of visible light of a first additional hue is a light emitting diode.

24. A lighting device as recited in claim 14, wherein said at least one source of visible light of a first additional hue is a luminescent material.

25. A lighting device as recited in claim 14, wherein said at least one source of visible light of a first additional hue is a phosphor.

26. A lighting device as recited in claim 14, wherein said at least one source of visible light of a first additional hue is saturated.

27. A lighting device comprising:

a plurality of sources of visible light, said sources of visible light each being independently selected from among solid state emitters and luminescent materials, each of said sources of visible light, when illuminated, emitting light of a hue, said sources of visible light, when illuminated, emitting in total at least three different hues, said sources of visible light comprising a first group of sources of visible light and a second group of sources of visible light, said first group of sources of visible light comprising sources of visible light which, when illuminated, emit light of at least two hues which, if mixed in the absence of any other light, produce a first group mixed illumination which would have color x,y coordinates which are within an area on a 1931 CIE Chromaticity Diagram defined by five points having x,y coordinates: 0.59, 0.24; 0.40, 0.50; 0.24, 0.53; 0.17, 0.25; and 0.30, 0.12, said second group of sources of visible light comprising at least one additional source of visible light, wherein mixing of light from said first group of sources of visible light and light from said second group of sources of visible light produces a first group-second group mixed illumination of a hue which is within ten MacAdam ellipses of at least one point on a blackbody locus on said 1931 CIE Chromaticity Diagram, and wherein an intensity of at least one of said hues is at least 35% of an intensity of said first group-second group mixed illumination.

28. A lighting device as recited in claim 27, wherein said first group mixed illumination would have x,y color coordinates which are within an area on a 1931 CIE Chromaticity Diagram defined by four points having x,y coordinates: 0.41, 0.45; 0.37, 0.47; 0.25, 0.27; and 0.29, 0.24.

29. A lighting device as recited in claim 27, wherein mixing of light from said first group of sources of visible light and light from said second group of sources of visible light produces a first group-second group mixed illumination of a hue which is within six MacAdam ellipses of at least one point on a blackbody locus on said 1931 CIE Chromaticity Diagram.

30. A lighting device as recited in claim 27, wherein mixing of light from said first group of sources of visible light and light from said second group of sources of visible light produces a first group-second group mixed illumination of a hue which is within three MacAdam ellipses of at least one point on a blackbody locus on said 1931 CIE Chromaticity Diagram.

31. A lighting device as recited in claim 27, wherein said first group-second group mixed illumination has a CRI of at least 85.

32. A lighting device as recited in claim 27, wherein said first group-second group mixed illumination has a CRI of at least 90.

33. A lighting device as recited in claim 27, wherein a combined intensity of said light from said first group of sources of visible light is at least 60% of an intensity of said first group-second group mixed illumination.

34. A lighting device as recited in claim 27, wherein a combined intensity of said light from said first group of sources of visible light is at least 70% of an intensity of said first group-second group mixed illumination.

35. A lighting device as recited in claim 27, wherein said at least one additional source of visible light is a solid state light emitter.

36. A lighting device as recited in claim 27, wherein said at least one additional source of visible light is a light emitting diode.

37. A lighting device as recited in claim 27, wherein said at least one additional source of visible light is a luminescent material.

38. A lighting device as recited in claim 27, wherein said at least one additional source of visible light is a phosphor.

39. A lighting device as recited in claim 27, wherein said at least one additional source of visible light is saturated.

40. A method of lighting, comprising:

mixing light from a plurality of sources of visible light, said sources of visible light each being independently selected from among solid state light emitters and luminescent materials, each source of visible light, when illuminated, emitting light of a hue, said sources of visible light, when illuminated, emitting in total three different hues, said sources of visible light comprising a first group of sources of visible light and a second group of sources of visible light, said first group of sources of visible light comprising sources of visible light which, when illuminated, emit light of two hues which, if mixed in the absence of any other light, produce a first group mixed illumination which would have x,y color coordinates which are within an area on a 1931 CIE Chromaticity Diagram defined by five points having x,y coordinates: 0.59, 0.24; 0.40, 0.50; 0.24, 0.53; 0.17, 0.25; and 0.30, 0.12, said second group of sources of visible light comprising at least one source of visible light of a first additional hue, wherein mixing of light from said first group of sources of visible light and light from said second group of sources of visible light produces a first group-second group mixed illumination of a hue which is within ten MacAdam ellipses of at least one point on a blackbody locus on said 1931 CIE Chromaticity Diagram.

41. A method as recited in claim 40, wherein said first group mixed illumination would have x,y color coordinates which are within an area on a 1931 CIE Chromaticity Diagram defined by four points having x,y coordinates: 0.41, 0.45; 0.37, 0.47; 0.25, 0.27; and 0.29, 0.24.

42. A method as recited in claim 40, wherein mixing of light from said first group of sources of visible light and light from said second group of sources of visible light produces a first group-second group mixed illumination of a hue which is within six MacAdam ellipses of at least one point on a blackbody locus on said 1931 CIE Chromaticity Diagram.

43. A method as recited in claim 40, wherein mixing of light from said first group of sources of visible light and light from said second group of sources of visible light produces a first group-second group mixed illumination of a hue which is within three MacAdam ellipses of at least one point on a blackbody locus on said 1931 CIE Chromaticity Diagram.

44. A method as recited in claim 40, wherein said first group-second group mixed illumination has a CRI of at least 85.

45. A method as recited in claim 40, wherein said first group-second group mixed illumination has a CRI of at least 90.

46. A method as recited in claim 40, wherein a combined intensity of said light from said first group of sources of visible light is at least 60% of an intensity of said first group-second group mixed illumination.

47. A method as recited in claim 40, wherein a combined intensity of said light from said first group of sources of visible light is at least 70% of an intensity of said first group-second group mixed illumination.

48. A method as recited in claim 40, wherein said at least one source of visible light of a first additional hue is a solid state light emitter.

49. A method as recited in claim 40, wherein said at least one source of visible light of a first additional hue is a light emitting diode.

50. A method as recited in claim 40, wherein said at least one source of visible light of a first additional hue is a luminescent material.

51. A method as recited in claim 40, wherein said at least one source of visible light of a first additional hue is a phosphor.

52. A method as recited in claim 40, wherein said at least one source of visible light of a first additional hue is saturated.

53. A method of lighting, comprising:

mixing light from a plurality of sources of visible light, said sources of visible light each being independently selected from among solid state light emitters and luminescent materials, each source of visible light, when illuminated, emitting light of a hue, said sources of visible light, when illuminated, emitting in total four different hues, said sources of visible light comprising a first group of sources of visible light and a second group of sources of visible light, said first group of sources of visible light comprising sources of visible light which, when illuminated, emit light of two hues which, if mixed in the absence of any other light, produce a first group mixed illumination which would have x,y color coordinates which are within an area on a 1931 CIE Chromaticity Diagram defined by five points having x,y coordinates: 0.59, 0.24; 0.40, 0.50; 0.24, 0.53; 0.17, 0.25; and 0.30, 0.12, said second group of sources of visible light comprising at least one source of visible light of a first additional hue and at least one source of visible light of a second additional hue;

wherein mixing of light from said first group of sources of visible light and light from said second group of sources of visible light produces a first group-second group mixed illumination of a hue which is within ten MacAdam ellipses of at least one point on a blackbody locus on said 1931 CIE Chromaticity Diagram.

54. A method as recited in claim 53, wherein said first group mixed illumination would have x,y color coordinates which are within an area on a 1931 CIE Chromaticity Diagram defined by four points having x,y coordinates: 0.41, 0.45; 0.37, 0.47; 0.25, 0.27; and 0.29, 0.24.

55. A method as recited in claim 53, wherein mixing of light from said first group of sources of visible light and light from said second group of sources of visible light produces a first group-second group mixed illumination of a hue which is within six MacAdam ellipses of at least one point on a blackbody locus on said 1931 CIE Chromaticity Diagram.

56. A method as recited in claim 53, wherein mixing of light from said first group of sources of visible light and light from said second group of sources of visible light produces a first group-second group mixed illumination of a hue which is within three MacAdam ellipses of at least one point on a blackbody locus on said 1931 CIE Chromaticity Diagram.

57. A method as recited in claim 53, wherein said first group-second group mixed illumination has a CRI of at least 85.

58. A method as recited in claim 53, wherein said first group-second group mixed illumination has a CRI of at least 90.

59. A method as recited in claim 53, wherein a combined intensity of said light from said first group of sources of visible light is at least 60% of an intensity of said first group-second group mixed illumination.

60. A method as recited in claim 53, wherein a combined intensity of said light from said first group of sources of visible light is at least 70% of an intensity of said first group-second group mixed illumination.

61. A method as recited in claim 53, wherein said at least one source of visible light of a first additional hue is a solid state light emitter.

62. A method as recited in claim 53, wherein said at least one source of visible light of a first additional hue is a light emitting diode.

63. A method as recited in claim 53, wherein said at least one source of visible light of a first additional hue is a luminescent material.

64. A method as recited in claim 53, wherein said at least one source of visible light of a first additional hue is a phosphor.

65. A method as recited in claim 53, wherein said at least one source of visible light of a first additional hue is saturated.

66. A method of lighting, comprising:

mixing light from a plurality of sources of visible light, said sources of visible light each being independently selected from among solid state emitters and luminescent materials, each of said sources of visible light, when illuminated, emitting light of a hue, said sources of visible light, when illuminated, emitting in total at least three different hues, said sources of visible light comprising a first group of sources of visible light and a second group of sources of visible light, said first group of sources of visible light comprising sources of visible light which, when illuminated, emit light of at least two hues which, if mixed in the absence of any other light, produce a first group mixed illumination which would have color x,y coordinates which are within an area on a 1931 CIE Chromaticity Diagram defined by five points having x,y coordinates: 0.59, 0.24; 0.40, 0.50; 0.24, 0.53; 0.17, 0.25; and 0.30, 0.12, said second group of sources of visible light comprising at least one source of visible light, wherein mixing of light from said first group of sources of visible light and light from said second group of sources of visible light produces a first group-second group mixed illumination of a hue which is within ten MacAdam ellipses of at least one point on a blackbody locus on said 1931 CIE Chromaticity Diagram, and wherein an intensity of at least one of said hues is at least 35% of an intensity of said first group-second group mixed illumination.

67. A method as recited in claim 66, wherein said first group mixed illumination would have x,y color coordinates which are within an area on a 1931 CIE Chromaticity Diagram defined by four points having x,y coordinates: 0.41, 0.45; 0.37, 0.47; 0.25, 0.27; and 0.29, 0.24.

68. A method as recited in claim 66, wherein mixing of light from said first group of sources of visible light and light from said second group of sources of visible light produces a first group-second group mixed illumination of a hue which is within six MacAdam ellipses of at least one point on a blackbody locus on said 1931 CIE Chromaticity Diagram.

69. A method as recited in claim 66, wherein mixing of light from said first group of sources of visible light and light from said second group of sources of visible light produces a first group-second group mixed illumination of a hue which is within three MacAdam ellipses of at least one point on a blackbody locus on said 1931 CIE Chromaticity Diagram.

70. A method as recited in claim 66, wherein said first group-second group mixed illumination has a CRI of at least 85.

71. A method as recited in claim 66, wherein said first group-second group mixed illumination has a CRI of at least 90.

72. A method as recited in claim 66, wherein a combined intensity of said light from said first group of sources of visible light is at least 60% of an intensity of said first group-second group mixed illumination.

73. A method as recited in claim 66, wherein a combined intensity of said light from said first group of sources of visible light is at least 70% of an intensity of said first group-second group mixed illumination.

74. A method as recited in claim 66, wherein said at least one additional source of visible light is a solid state light emitter.

75. A method as recited in claim 66, wherein said at least one additional source of visible light is a light emitting diode.

76. A method as recited in claim 66, wherein said at least one additional source of visible light is a luminescent material.

77. A method as recited in claim 66, wherein said at least one additional source of visible light is a phosphor.

78. A method as recited in claim 66, wherein said at least one additional source of visible light is saturated.

* * * * *